US006902085B2

(12) United States Patent
Bougamont et al.

(10) Patent No.: US 6,902,085 B2
(45) Date of Patent: Jun. 7, 2005

(54) LIQUID OR GEL PRODUCT DISPENSER FORMING A METERING STICK

(75) Inventors: Jean-Louis Bougamont, Eu (FR); François Nicolle, Dampierre St Nicolas (FR)

(73) Assignee: Rexam Dispensing Systems S.A.S., (FR)

( * ) Notice: Subject to any disclaimer, the term of this patent is extended or adjusted under 35 U.S.C. 154(b) by 0 days.

(21) Appl. No.: 10/485,639

(22) PCT Filed: Aug. 2, 2002

(86) PCT No.: PCT/FR02/02796

§ 371 (c)(1),
(2), (4) Date: Nov. 19, 2004

(87) PCT Pub. No.: WO03/013736

PCT Pub. Date: Feb. 20, 2003

(65) Prior Publication Data

US 2005/0072810 A1 Apr. 7, 2005

(30) Foreign Application Priority Data

Aug. 3, 2001 (FR) ..... 01 10445

(51) Int. Cl.[7] ..... B65D 88/54

(52) U.S. Cl. ..... 222/321.7; 222/386

(58) Field of Search ..... 222/321.7, 386, 222/380, 321.2, 405

(56) References Cited

U.S. PATENT DOCUMENTS 3,908,870 A * 9/1975 Nozawa et al. ..... 222/321.2
4,079,865 A * 3/1978 Kutik ..... 222/321.9

* cited by examiner

*Primary Examiner*—Philippe Derakshani
(74) *Attorney, Agent, or Firm*—St. Onge Steward Johnston & Reens LLC

(57) ABSTRACT

The invention concerns a liquid or gel product dispenser, comprising a reservoir (R) supporting a pump body (1) including in its lower part an intake valve (2) and provided with a piston (3) mobile along an axis, defining with said body a metering chamber communicating with at least an ejection orifice defined in an axially mobile dispensing nozzle at the end of the reservoir; said piston is coupled by friction with said dispensing nozzle, which is axially mobile in both directions by manual actuation, relative to said reservoir; said metering chamber comprises a lower section (10*a*) and an upper section (10*b*), both sections communicating via a conduit (30) arranged across said piston and a closure valve (5) is arranged between said piston and said nozzle.

20 Claims, 3 Drawing Sheets

LIQUID OR GEL PRODUCT DISPENSER FORMING A METERING STICK

The present invention relates to a dispenser for a liquid or gel product, such as a cosmetic or pharmaceutical product.

Dispensers are already known of the type comprising a reservoir supporting a pump body sealed at the bottom by an inlet valve and provided at the top with a piston which, with the body, delimits a metering chamber comprising at least one discharge orifice, the pump body cooperating with a dispensing nozzle which is axially displaceable on the reservoir.

However, in such dispensers, if there is a sealing valve intended to prevent the product from escaping, said valve is located in the pump and at an appreciable distance from the discharge orifice. The presence of any residue of product in the zone in contact with the external atmosphere is, however, likely to bring about a blockage of the dispensing channels by drying and/or result in risks of contamination.

Furthermore, these dispensers use means, taking the form of one or more metallic springs, for returning the piston to the raised position. Such springs are not always chemically or biologically compatible with the packaged products.

Finally, the tightness of the bottom part of the pump body is not sufficiently reliable, which compromises the accuracy of metering.

The aim of the present invention is to solve these various technical problems in a satisfactory manner.

More particularly, the invention relates to a liquid or gel product dispenser, of the type comprising a reservoir supporting a pump body comprising at the bottom an inlet valve and provided with a piston movable along an axis, which delimits, with said body, a metering chamber which communicates with at least one discharge orifice defined in an axially displaceable dispensing nozzle at the end of said reservoir, wherein said piston is coupled frictionally to said dispensing nozzle, which nozzle is axially displaceable in both directions relative to said reservoir by manual actuation, between two predetermined positions, wherein said metering chamber comprises, on the one hand, a lower compartment defined between said body and said piston and, on the other hand, an upper compartment defined between the piston and said nozzle, the two compartments communicating via a duct formed through said piston and wherein a sealing valve is arranged between said piston and said nozzle to isolate said metering chamber from said orifice.

According to one possible embodiment, the nozzle takes the form of a cap arranged so as partially to enclose said reservoir, said cap having an upper wall, substantially perpendicular to said axis, in which said discharge orifice is provided. Since this wall may be relatively thin, the discharge orifice or orifices may amount to a shallow hole in which the quantity of product capable of drying is minute. According to one of the embodiments, the piston comes directly into contact with this hole on the inside, and according to another embodiment, the sealing valve comprises a sealing element which is borne by the piston and engages in leak-free manner in the discharge orifice itself such that there is no product which is capable of drying.

According to one advantageous feature, the piston bears a collar, external to the pump body, which slides in leak-free manner within the nozzle, so compressing the product in the upper compartment in order to expel it towards the outside.

According to another advantageous feature, the collar comprises an upper shoulder which is extended at its periphery and downward by a lateral skirt. Said skirt slides with a certain degree of friction in the nozzle itself.

The lower edge of this skirt is preferably provided with a retaining ring which cooperates with an upper flange of the pump body to provide the limit stop for the collar in the raised position.

According to a first variant, one or more discharge orifices are formed through the upper wall of the nozzle in line with said collar of the piston.

According to another variant, the single discharge orifice is formed through the upper wall of the nozzle in the axis of the central duct of the piston. The sealing element borne by the piston is capable of engaging in this discharge orifice.

According to another variant, the sealing valve comprises a sealing element protruding axially from the inner face of said upper wall of the nozzle. This sealing element is capable of engaging in leak-free manner in the top part of the central duct of the piston.

According to another feature, the pump body is provided at the top with a peripheral groove in which an annular sealing lip, integral with said collar of the piston, slides axially.

According to one variant, the reservoir comprises a bottle accommodating an internal support bush for the pump body. The dispensing nozzle is fitted movably on this bush.

According to one variant, the internal wall of the reservoir comprises a set of flexible stop fins which cooperate with complementary fins borne by the nozzle.

The configuration of the dispenser according to the invention, equipped with a two-compartment chamber, forms a discharge lock which promotes even dispensing of the product.

Furthermore, the location of the sealing valve makes it possible to ensure tightness at the top, making the dispenser air-tight and protecting the product.

Moreover, tightness at the bottom is promoted by the locking of the inlet valve in the closed position by means of the piston itself.

The invention will be better understood on reading the following description made with reference to the drawings, in which.

Figure 1:
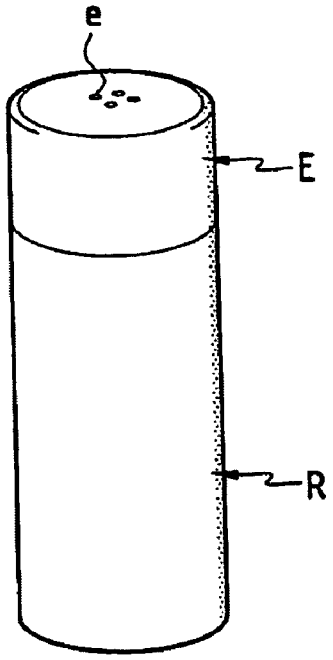
FIG. 1 is a perspective view of a first embodiment of the dispenser of the invention.

The dispenser shown in the Figures is more particularly intended for packaging cosmetic or pharmaceutical products. As shown in FIG. 1, the first embodiment of the dispenser is of a cylindrical shape similar to a stick.

This dispenser comprises a reservoir R supporting a pump body 1 sealed at the bottom by an inlet valve 2 and extended by an aspiration tube 11 extending into the reservoir. The valve 2 consists of a ball 21 accommodated in a frustoconical part 12 of the pump body 1, which delimits a feed channel. The ball has a degree of freedom of axial movement between two limit stops.

The reservoir R is surmounted by a dispensing nozzle E in the wall of which there are provided four discharge orifices e. The nozzle E takes the form of a cap with an overall cylindrical shape, as described above. The body 1 is provided at the top with a piston 3 which, with the body 1 and the nozzle E, delimits a metering chamber which communicates with the discharge orifices e. A sealing valve 5 is defined between the nozzle E and the piston 3. The nozzle E is axially displaceable relative to the reservoir R, it being possible, for example, to provide translational, sliding axial displacement of the nozzle E relative to the reservoir or, according to one variant (not shown), axial displacement by screwing/unscrewing the nozzle E on the reservoir R.

In the embodiment of FIGS. 2A to 2D, the reservoir R comprises a bottle F accommodating an internal support bush d for the pump body 1.

The lower part of the bush d is press-fitted in the neck of the reservoir with radial clamping. The bush is shaped so as to delimit, with the reservoir, an annular space 6 in which the wall of the nozzle E is accommodated and moves translationally and/or rotationally. The pump body 1 is provided with a vent orifice 14 formed through its side wall in the part located inside the reservoir R which allows intake of air. This orifice 14 is associated here with a groove 15 since the top part of the body 1 is also press-fitted with slight radial clamping in the neck of the bush d.

Figure 2D:
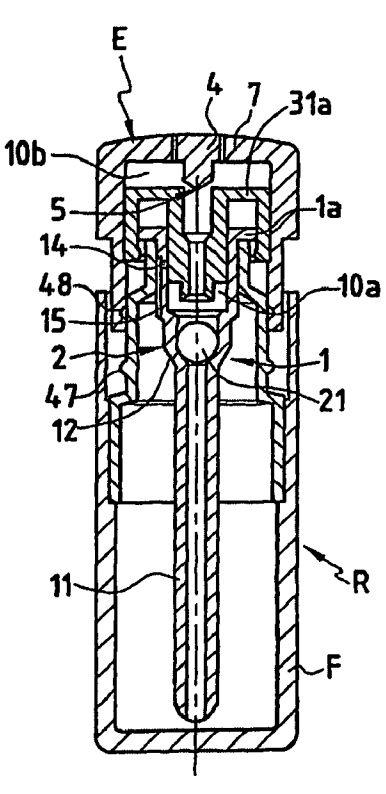
FIGS. 2A to 2D show vertical sectional views of the dispenser of FIG. 1 in different positions.
Figure 2C:
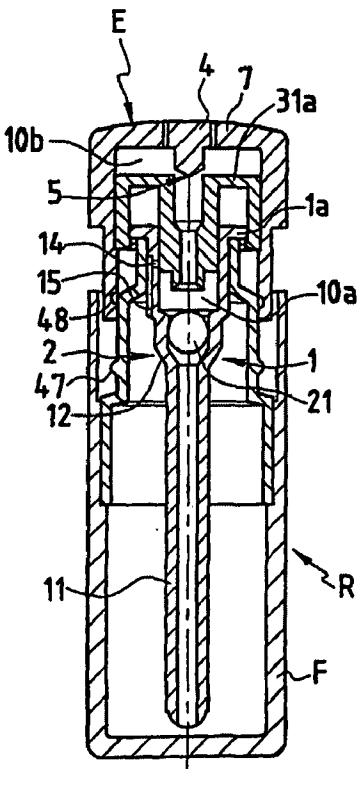
Figure 2B:
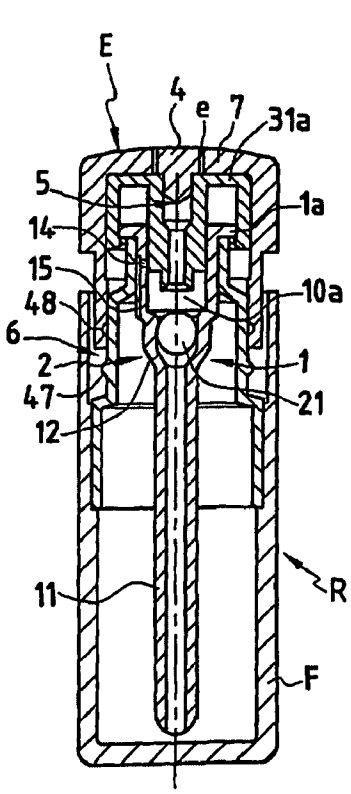
Figure 5A:
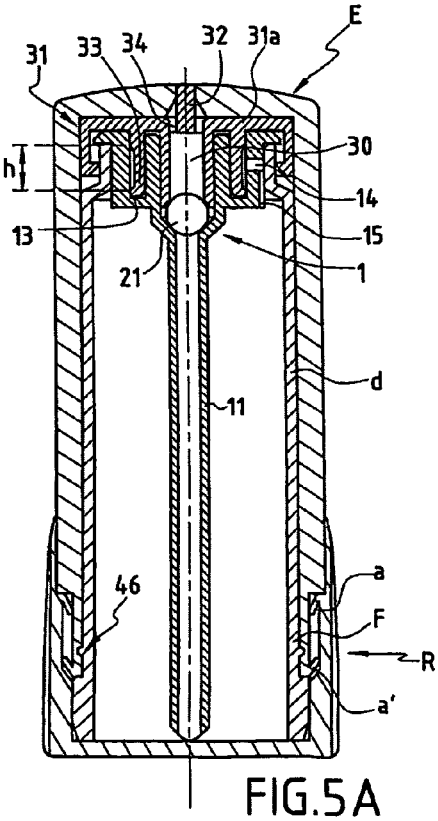
FIGS. 5A and 5B are vertical sectional views of the dispenser of FIG. 4 respectively in closed and open position.
Figure 5B:
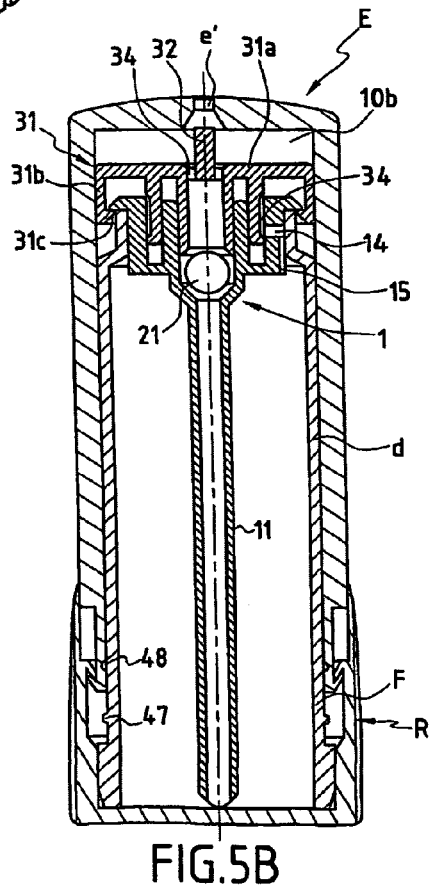

The metering chamber is constituted, on the one hand, by a lower compartment 10*a* located between the body 1 and the central cylindrical part 3*a* of the piston 3 and, on the other hand, by an upper compartment 10*b* located between the piston 3 and the internal wall of the nozzle E (see FIGS. 2C, 2D and 5B). The lower compartment 10*a* and upper compartment 10*b* are of variable volume and are capable of communicating one with the other via a duct 30 formed here axially through the central part 3*a* of the piston 3.

The piston 3 bears a collar 31, external to the body 1, which delimits part of the compartment lob and is capable of sliding in leak-free manner within the nozzle E in order to compress the product in the upper compartment lob.

The piston 3 is translationally movable axially relative both to the pump body 1 and to the nozzle E. It is coupled frictionally to the nozzle E, thanks to the skirt 31*c*. It comes to rest, at the bottom, against the ball 21 of the inlet valve 2, and at the top against the inner face of the upper wall 7 of the nozzle E. As can be seen, this wall is substantially perpendicular to the axis of displacement of the piston.

The piston 3 thus performs a double action, successively in the lower compartment 10*a* then in the upper compartment lob of the metering chamber, resulting in discharge of the product in two phases.

The collar 31 comprises an upper shoulder 31*a* extended at its periphery and downward by a lateral skirt 31*b* which slides with slight friction against the cylindrical internal lateral wall of the nozzle E. The lower edge of the skirt 31*b* is provided with a retaining ring 31*c* which cooperates with an upper flange 1*a* of the body 1, in order to provide the top limit stop for the collar 31.

Figure 3:
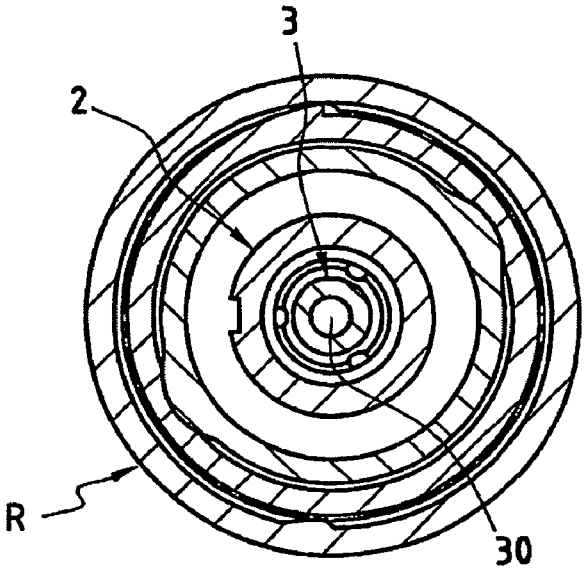
FIG. 3 shows a horizontal sectional view of the dispenser of FIG. 1 in the position of FIG. 2A.
Figure 2A:
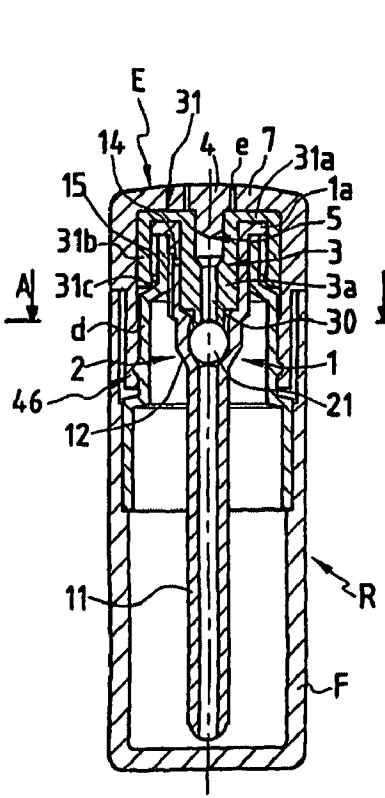

In the embodiment of FIGS. 1 to 3, the sealing valve 5 is constituted by a sealing element in the form of pin 4, protruding from the inner face of the wall 7 of the nozzle E. This pin is capable of engaging in a leak-proof sliding manner in the top part of the duct 30 of the piston. Four discharge orifices e are arranged around this pin. Tightness of the closure of the sealing valve is here mainly achieved by gentle sliding engagement of the pin 4 in the top part of the duct 30. However, since the orifices are here formed through the upper wall of the nozzle E, opposite the shoulder 31*a* of the collar 31, an additional sealing wall is provided. Operation of the embodiment described in FIGS. 1 to 3 is as follows:

As the nozzle E rises from the position shown on FIG. 2A, the piston is lifted upwards by friction while remaining blocked in the nozzle E, which results in opening of the inlet valve and filling of the lower compartment (FIG. 2B) until the ring 31*c* of the piston comes into abutment against flange 1*a* of the pump body. As the unscrewing proceeds, the nozzle is separated from the piston, so freeing the upper compartment 10*b* which in turn fills. This displacement is accompanied by release of the discharge orifices e and prepares the system for dispensing the product (FIG. 2C).

On descending, the nozzle moves, taking with it first the piston 3 retained by radial clamping, the discharge orifices being open and the inlet valve 2 closed. Compression of the product in the lower compartment 10*a* brings about discharge thereof. When the piston comes into abutment against the pump body, closure of the inlet valve 2 is reinforced and the nozzle E continues to descend, compressing the product in the upper compartment 10*b* (FIG. 2D) until the discharge orifices e are sealed on the inside.

At the end of the stroke, blocking means 46, which operate in the manner of clips, stabilize the position of the nozzle E relative to the reservoir R. These blocking means here take the form of an annular ring 47 provided on the outside of the bush d and a corresponding annular groove 48 formed at the bottom of the internal wall of the nozzle E. These blocking means confirm and reinforce the closure of the inlet valve 2 and of the sealing valve 5.

Figure 4:
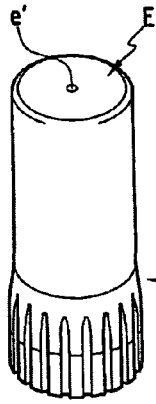
FIG. 4 is a perspective view of a second embodiment of the dispenser of the invention.

In the embodiment of FIGS. 4, 5A and 5B, those parts which are similar to those of the embodiment of FIGS. 1 to 3 are denoted by the same reference numbers/letters. The sealing element is borne by the piston 3 and is capable of engaging in a leak-proof sliding manner in a single discharge orifice e' of the nozzle E. The element comprises a stud 32 integral with the collar 31 and extending coaxially with the duct 30.

The single discharge orifice e' is formed through the upper wall of the nozzle E in the axis of the duct 30 but in this case with a diameter greater than that of the orifices e of the previously described embodiment. The orifice e' is of cylindroconical section whereas the stud 32 is cylindrical.

The central duct 30 here opens into the upper compartment 10*b* of the metering chamber, via slots 34 formed in the shoulder 31*a*, defined between connecting lands around the stud 32.

In this second embodiment, the pump body 1 is provided at the top with a peripheral groove 13 in which there slides an annular sealing lip 33 connected to the piston 3. Said lip is borne by the lower face of the shoulder 31*a* of the collar 31. A vent orifice 14 is provided between the upper lateral wall of the body and the groove 13. This orifice is associated with a groove 15 since the top part of the body 1 is press-fitted with slight radial clamping in the bush d. Air can flow between the bush d and the nozzle E (see FIG. 5B).

The lateral wall of the lip 33 has an indentation 35 on its radially outer face which extends to a height h. This indentation delimits a passage for the intake of air into the reservoir R, via the orifice 14, in the raised position of the collar 31.

The internal wall of the reservoir R and more precisely of the bottle F comprises a set of flexible stop fins a which cooperate with complementary fins a' borne by the lower part of the outer lateral wall of the nozzle E.

The flexibility of the fins a, a' makes it possible to introduce the lower edge of the nozzle E into the gap located between the bottle F and the bush d.

When the nozzle E arrives in the raised position, the fins a' of the nozzle come into abutment against the fins a of the bottle and prevent any separation.

This embodiment facilitates packaging of the product into the reservoir R, by filling the bush d upside down with the nozzle E in the closed position. The bottle F is then fitted in the manner of a bung onto the bush d to form the bottom of the reservoir before the dispenser is turned the right way up.

The mode of operation of the dispenser according to this second embodiment is described hereafter.

In the position shown in FIG. 5A, the end of the piston comes to rest, by the lower edge of the duct 30, at the bottom against the ball 21 to lock the inlet valve in the closed position. The blocking means 46 reinforce this locking.

In this position, the volume of the metering chamber is minimal since the nozzle E is in the bottom position in contact with the shoulder 31*a* of the collar 31. The free volumes of the compartments 10*a* and 10*b* are virtually zero.

The sealing element 32 is engaged in the discharge orifice e' (FIG. 5A), so ensuring complete tightness of the dispenser without any proportion of the product being in contact with the atmosphere.

When the nozzle E is displaced upward from the previous position, taking with it the collar 31 of the piston 3, the inlet valve opens and the lower compartment 10*a* fills with product. The movement continues until the ring 31*c* comes into abutment against the upper edge of the body 1. Continuing displacement of the nozzle E brings about a separation between the nozzle and the collar 31 of the piston (FIG. 5B), which remains in abutment against the body 1. This releases the central duct 30 and the discharge orifice e'. In this manner, the sealing valve is opened.

Then, continuation of the movement of the nozzle E is accompanied by filling of the upper compartment lob of the metering chamber as shown in FIG. 5B, while compressing the product in both compartments of the chamber, resulting in the product being dispensed via the orifice e'.

It is noteworthy that in the two embodiments described above, the sealing valve is arranged in the immediate proximity of the discharge orifice(s) (e or e') formed in the end wall of the nozzle E. Any contact between the product and the atmosphere when the dispenser is closed is thus avoided. Not only is the risk of the device becoming blocked up due an excessive quantity of product drying out avoided, but so too is any risk of contamination of said product.

What is claimed is:

1. A liquid or gel product dispenser, of the type comprising a reservoir supporting a pump body comprising at the bottom an inlet valve and provided with a piston movable along an axis, which delimits, with said body, a metering chamber which communicates with at least one discharge orifice defined in an axially displaceable dispensing nozzle at the end of said reservoir, wherein said piston is coupled frictionally to said dispensing nozzle, which nozzle is axially displaceable in both directions relative to said reservoir by manual actuation, between two predetermined positions, wherein said metering chamber comprises, on the one hand, a lower compartment defined between said body and said piston and, on the other hand, an upper compartment defined between the piston and said nozzle, the two compartments communicating via a duct formed through said piston and wherein a sealing valve is arranged between said piston and said nozzle to isolate said metering chamber from said orifice.

2. The dispenser as claimed in claim 1, wherein said nozzle takes the form of a cap arranged so as partially to enclose said reservoir, said cap having an upper wall, substantially perpendicular to said axis, in which said discharge orifice is provided.

3. The dispenser as claimed in claim 1, wherein said piston bears a collar, external to the pump body, which slides inside said nozzle while compressing the product in the upper compartment.

4. The dispenser as claimed in claim 2, wherein said collar of the piston comprises an upper shoulder extended at its periphery and downward by a lateral skirt, said lateral skirt sliding inside said nozzle.

5. The dispenser as claimed in claim 4, wherein the lower edge of said skirt is provided with a retaining ring which cooperates with the upper flange of the body to provide the limit stop for the collar in the raised position.

6. The dispenser as claimed in claim 1, wherein the lower end of said piston is shaped so as to lock said inlet valve in the closed position.

7. The dispenser as claimed in claim 3, wherein said discharge orifice is formed through the upper wall of the nozzle in line with said collar of said piston.

8. The dispenser as claimed in claim 2, wherein said discharge orifice is formed through the upper wall of the nozzle in the axis of the central duct of said piston.

9. The dispenser as claimed in claim 2, wherein said sealing valve comprises a sealing element protruding from the inner face of said upper wall of the nozzle and capable of engaging the top part of the central duct of the piston.

10. The dispenser as claimed in claim 8, wherein said sealing valve comprises a sealing element borne by the piston and capable of engaging in the discharge orifice.

11. The dispenser as claimed in claim 1, wherein the pump body is provided at the top with a peripheral groove in which an annular sealing lip connected externally to said piston slides axially.

12. The dispenser as claimed in claim 1, wherein said reservoir comprises a bottle which accommodates an internal support bush for the pump body and on which the dispensing nozzle is fitted movably.

13. The dispenser as claimed in claim 1, wherein the internal wall of said reservoir comprises a set of flexible stop fins which cooperate with complementary fins borne by the nozzle.

14. A product dispenser comprising:

a reservoir for holding said product to be dispensed;

a dispensing nozzle at one end of said reservoir, said nozzle axially displaceable relative to said reservoir and defining at least one discharge orifice;

a pump body comprising an inlet valve;

a piston axially displaceable relative to said reservoir and said nozzle, said piston defining a lower compartment between said body and said piston and an upper compartment between said piston and said nozzle, the two compartments connected to form a metering chamber in fluid flow communication with said at least one of said discharge orifices; and a sealing valve for isolating said metering chamber from said at least one discharge orifice.

15. The dispenser as claimed in claim 14, wherein said nozzle comprises a cap partially enclosing said reservoir.

16. The dispenser as claimed in claim 15, wherein said piston comprises a collar forming a seal against an inside wall of said nozzle to permit compression of said product in said upper compartment during dispensing of said product.

17. The dispenser as claimed in claim 16, wherein said collar of the piston comprises an upper shoulder extended at its periphery and downward by a lateral skirt, said lateral skirt sliding inside said nozzle.

18. The dispenser as claimed in claim 14, wherein a lower end of said piston cooperates with said body to close said inlet valve.

19. The dispenser as claimed in claim 14, wherein said metering chamber communicates with at least one discharge orifice via a flow path through said piston, and wherein said sealing valve comprises a sealing element protruding from an inner face of said nozzle for engaging said piston to obstruct said flow path.

20. The dispenser as claimed in claim 14, wherein said sealing valve comprises a sealing element borne by said piston for engaging in said at least one discharge orifice.

* * * * *